US005609336A

United States Patent [19]

Tashjian

[11] Patent Number: 5,609,336

[45] Date of Patent: Mar. 11, 1997

[54] ADJUSTABLE HOCKEY STICK

[76] Inventor: Jerry J. Tashjian, 31 Sunset Rd., Needham, Mass. 02194

[21] Appl. No.: 641,577

[22] Filed: May 1, 1996

[51] Int. Cl.[6] ..... A63B 59/14

[52] U.S. Cl. ..... 473/560; 473/296

[58] Field of Search ..... 273/67 A, 67 R, 273/73 J, 72 R, 72 A, 26 B; 473/296

[56] References Cited

U.S. PATENT DOCUMENTS 3,712,652 1/1973 Uilkema ..... 473/296
5,263,711 11/1993 Addis et al. ..... 273/67 A

FOREIGN PATENT DOCUMENTS 633295 12/1961 Canada ..... 273/67 A
1366165 1/1988 U.S.S.R. .

*Primary Examiner*—Mark S. Graham
*Attorney, Agent, or Firm*—Herbert L. Bello

[57] ABSTRACT

An adjustable hockey stick with a handle having inner and outer telescopic members that are relatively movable for adjusting the length of the handle. A locking element having two pivotally connected sections are provided for locking the inner and outer members at selected positions. The inner and outer members are fixed in position by inserting the locking element into registered apertures in the outer and inner members. The locking element is secured in position by bending it at its pivot connection. When the locking element is removed, the inner and outer members are frictionally movable for lengthening or shortening the handle. A hockey blade is provided at the working end of the hockey stick.

19 Claims, 6 Drawing Sheets

ADJUSTABLE HOCKEY STICK

BACKGROUND OF THE INVENTION

1. Field of the Invention

The present invention relates to an apparatus useful in connection with the sport of hockey. More particularly, the invention is directed to a hockey stick having a lengthwise adjustable handle.

2. Description of the Prior Art

Hockey is increasingly enjoyed as both a competitive sport and an exercise activity. In response to an increased interest in street hockey, manufacturers have redesigned most of the equipment used in connection with this sport. These efforts have produced improvements in the design of, for example, the protective equipment used by players. The design of hockey stick handles, however, has remained substantially constant for an extended period. Indeed, the outward configuration of hockey sticks has remained substantially unchanged since inception of the sport. Improvements to the hockey stick have focused on increasing the strength and flexibility of the handle by manufacturing it from differing materials, i.e., metals and composites.

Hockey sticks generally include a handle and a blade. As noted above, extensive research efforts have been undertaken in order to increase the strength and flexibility of the handle portion. Despite these efforts, however, those handles currently available in the marketplace frequently fracture as a result of forces created by the receipt or delivery of a hockey puck. Similar problems have been encountered in connection with the blade component which is sized and shaped to receive and deliver the hockey puck. Although the handle and blade are typically integral components, if desired, the blade can be connected to the handle so as to permit replacement if either component is damaged during use.

Generally, a hockey stick is selected based on its overall height as compared to that of the player. Presently, hockey sticks are manufactured so as to have one of several predetermined lengths. At the time of purchase, the hockey stick is reduced in size, i.e., cut-down, as needed to accommodate a given consumer. This alteration in length is permanent and makes prolonged use of any hockey stick problematic at best. For example, as younger players grow, they must purchase new hockey sticks in order to replace those that have become too short. Sets of sticks purchased for use in connection with, for example, intramural sport teams, frequently do not include a sufficient diversity of lengths to be useful to all members of a given team.

Furthermore, hockey sticks that are sized for playing ice hockey and roller hockey (hockey played with ice skates and roller blades) are too long for playing street hockey (hockey played in street shoes or sneakers). Since ice skates and roller blades elevate the player higher than street shoes or sneakers, street hockey requires a shorter hockey stick. Players who wish to play ice hockey and roller hockey, as well as street hockey, are required to purchase hockey sticks of different lengths.

A need has arisen for a hockey stick having a handle with increased strength that is adjustable in overall length to accommodate changing circumstances.

SUMMARY OF THE INVENTION

It is an object of the present invention to provide a hockey stick apparatus that does not suffer from the foregoing disadvantages and limitations.

It is another object of the present invention to provide a hockey stick having an adjustable-length handle.

It is a further object of the present invention to provide a locking apparatus for use in connection with an adjustable-length handle that can be quickly and efficiently released, sized and secured in place.

It is yet another object of the present invention to provide an adjustable-length hockey stick in which the working components of a locking mechanism are flush-mounted vis-a-vis the outer surfaces of the hockey stick handle.

The hockey stick apparatus of the present invention is generally characterized by a handle, a locking element, and a blade. The handle typically includes an outer member sized and shaped to receive an inner member. In operation, the inner member is telescopically positionable within the outer member, the relative lateral disposition of the inner and outer members being incrementally adjustable. The locking element serves to secure the inner and outer members of the handle at selected locations.

Typically, the inner and outer members of the handle have a rectilinear cross-sectional configuration and are axially extending. The inner member frictionally engages the outer member in substantially surface-to-surface contact. The inner member and outer member cooperate to permit lengthwise adjustment of the size of the handle. To achieve this result, the inner member extends from one end of the outer member. An end portion of the inner member is configured to provide a grip. In addition to providing a handhold for grasping the inner member, this grip typically includes a stop element which limits insertion of the inner member into the outer member. That portion of the inner member forming the grip typically has an enlarged cross-sectional dimension as compared to the remainder of the inner member. Finally, the inner member preferably includes a transversely extending aperture configured to receive the locking element used to secure the inner and outer members at selected disposition.

The outer member typically has a hollow interior that is sized and shaped to receive the inner member. In addition to cooperating with the inner member to permit adjustment of the length of the handle, the outer member provides support for the blade element. Preferably, an aperture extends through opposing walls of the outer member. This aperture is sized and shaped to receive the locking element described in detail below for locking the inner and outer members.

The locking element secures the inner member against longitudinal movement relative to the outer member. The locking element preferably includes a first portion that is pivotally connected to a second portion. A cam surface at the pivotal connection between the first and second portion serves to assist in locking the inner member and outer member against relative movement.

Preferably, the first portion of the locking element is sized and shaped so as to extend transversely through the apertures in both the inner and outer members of the handle. Typically, one end of the first portion has a flattened head region with a series of working surfaces. In operation, the working surfaces of the head region engage the edges of the aperture in the outer member. The head region is substantially flush with an outer surface of the outer member when the locking element is secured in position. The second portion of the locking element acts to secure the assembly in position. Generally, when the second portion is in its secured position it is contained within the aperture in the inner member.

In the preferred embodiment of the invention, the locking element is a pin having a size and shape complementary to the configuration of the apertures in the inner and outer members. To position the pin, the apertures in the inner and outer members are first concentrically aligned. The pin is then thrust through the opening until the head region of the first portion is flush with an outer surface of the outer member. The second portion is then pivoted inwardly so that it is contained with the aperture in the inner member.

As noted above, a blade extends from the handle means. Preferably, the blade is positioned on the end of the outer member opposite to that which receives the inner member. Typically, the blade is removably and replaceably positionable on the handle.

Other general and specific objects of the invention will in part be obvious and will in part appear hereinafter.

The invention accordingly comprises the steps and apparatus embodying features of construction, combinations of elements and arrangements of parts adapted to effect such steps, as exemplified in the following detailed disclosure, and the scope of the invention is indicated in the claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
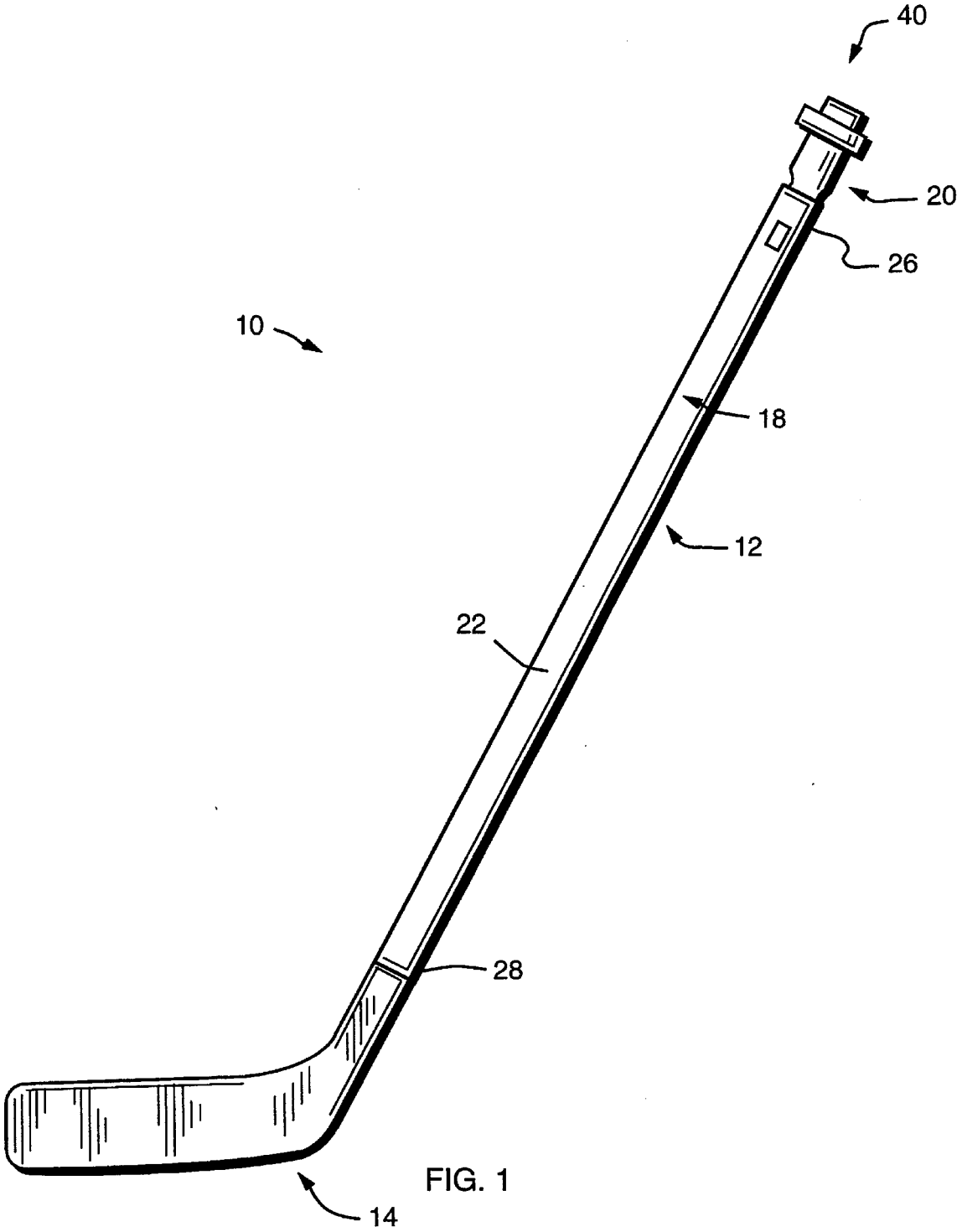
FIG. 1 is a side view of a hockey stick embodying the present invention.

The invention features a hockey stick having a lengthwise adjustable handle. The handle of the hockey stick 10 includes an inner member telescopically positioned within an outer member. To lengthen or shorten the handle, the inner member is pulled from, or pushed into, the outer member. In addition to allowing for adjustment to the length of the handle, the invention's combination of an inner member with an outer member increases the overall strength of the handle. Accordingly, the hockey stick of the invention is able to absorb increased dynamic forces without fracturing.

Referring now to FIGS. 1 through 7, wherein like reference numerals refer to like parts, there is illustrated a hockey stick 10. The hockey stick 10 includes a handle 12, a blade 14, and a locking element 16. The handle 12 typically includes an outer member 18 sized and shaped to receive an inner member 20. In operation, the inner member 20 is telescopically slidable within the outer member 18. The locking element 16 serves to secure the inner member 20 in outer member 18 at selected locations, the position of the inner member in the outer member determining the length of the handle 12.

Referring to FIGS. 1 through 4 and 7, the outer member 18 is a hollow, axially extending member having a rectilinear cross-sectional configuration. The external and internal cross-sectional dimensions of the outer member 18 can be substantially constant or variable depending on the configuration of the inner member 20 and blade element 14. Additional dimensional modifications may also be made in order to satisfy the specific needs of individual players. In the preferred embodiment of the invention as shown in the several FIGURES, the cross-sectional dimensions of the outer member 18 are substantially constant so as to form a rectangular housing capable of receiving the inner member 20.

The size and shape of the outer member 18 is defined by a series of sidewalls 22. The sidewalls 22 form an axially extending interior chamber 24 that is sized and shaped to slidably and snugly receive the inner member 20. The outer member 18 has a first end 26 and a second end 28. In operation, the first or upper end 26 receives the inner member 20. The second or lower end 28 is configured to removably and replaceably receive the blade 14. A pair of apertures 32 are formed in opposing sidewalls 22 of the outer member 18. In the preferred embodiment, the first of the apertures 32 has a substantially rectangular configuration and the other or second aperture 32 typically has a skeleton keyhole configuration. More particularly, this second aperture 32 has a first end portion having a substantially narrow configuration and a second end portion having a substantially, somewhat enlarged, circular configuration. This configuration for the second aperture 32 is preferred as it permits the body of the locking element 16 to fold into the inner member 20 when in its locked condition. The enlarged size of its circular portion of the second aperture 32 permits easy access for unlocking the locking element 16. In the illustrated embodiment, the first aperture 32 connects with the end of the first end portion away from the circular portion of the second aperture. The outer member 18 typically is composed of a wood, metal, or composite substrate. Those skilled-in-the-art will appreciate, however, that the outer member 18 can be manufactured from any material exhibiting sufficient mechanical strength to function as a hockey stick handle.

As shown in the FIGURES, the inner member 20 cooperates with outer member 18 to facilitate lengthwise adjustment of the size of the handle 12. When fully assembled as shown in FIG. 1, the inner member 20 extends from the first end 26 of the outer member 18.

Referring now to FIGS. 2 through 4 and 7, the inner member 20 is an axially extending member having a rectilinear cross-sectional configuration. A series of surfaces 44 define the size and shape of the inner member 20. The inner member 20 has a first end 40 and a second end 42.

In the preferred embodiment of the invention as shown in the FIGURES, the first end 40 extends from first end 26 of the outer member 18. The first end 40 typically includes an insertion portion 46, a transitional portion 48, and an enlarged head portion 50. The insertion portion 46 is sized and shaped to be smugly and slidably received in the interior chamber 24 of the outer member 18. Accordingly, the configuration of the insertion portion 46 is typically substantially identical to the shape of the interior chamber 24, the size of the insertion portion being such that it is snugly and slidably received within the interior chamber. The transitional portion 48 of the inner member 20 includes a flare 54 that defines a stop element 52. More particularly, the flare 54 of stop element 52 is configured such that between its starting and ending points it functions to increase the cross-sectional dimension of the inner member 20. As a result of the configuration of the flare 54, the grip portion 50 can not be inserted into the outer member 18. Accordingly, the flare 54 of stop element 52 acts to halt insertion of the inner member 20 into the outer member 18. The head 50 provides a handhold for grasping the inner member 20. Typically, head 50 has an enlarged cross-sectional dimension defined by the maximum enlargement provided by the flare 54. In the illustrated embodiment, a grip 51 is fitted on to head 50. Grip 51, for example, a sleeve having a rectangular profile with a central opening 53 that is sized and shaped to fit snugly on head 50. Typically, grip 51 is composed of a natural or synthetic rubber or a polymer, such as plastic.

Figure 3:
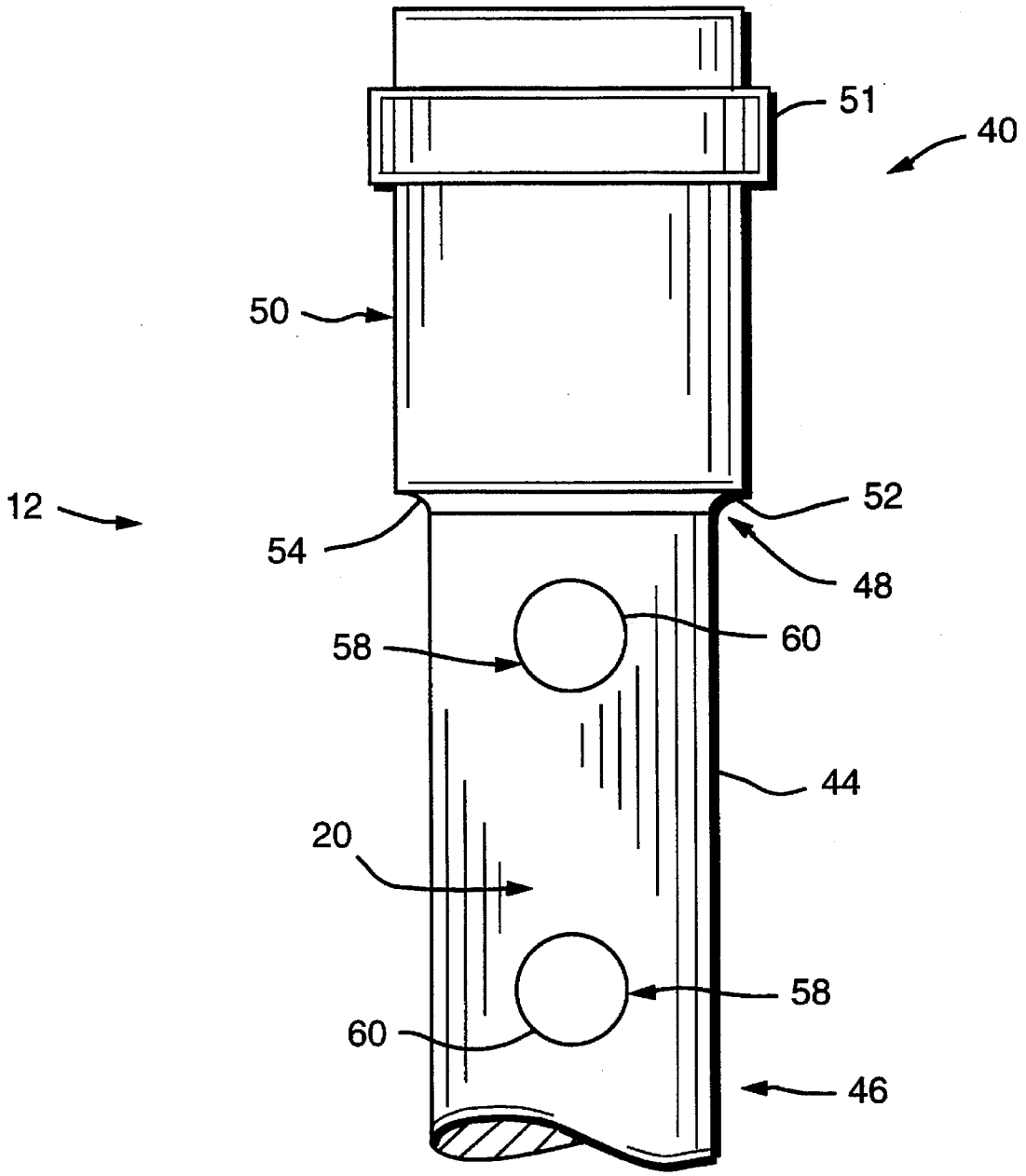
FIG. 3 is a front view of a portion of an inner member of the hockey stick.
Figure 4:
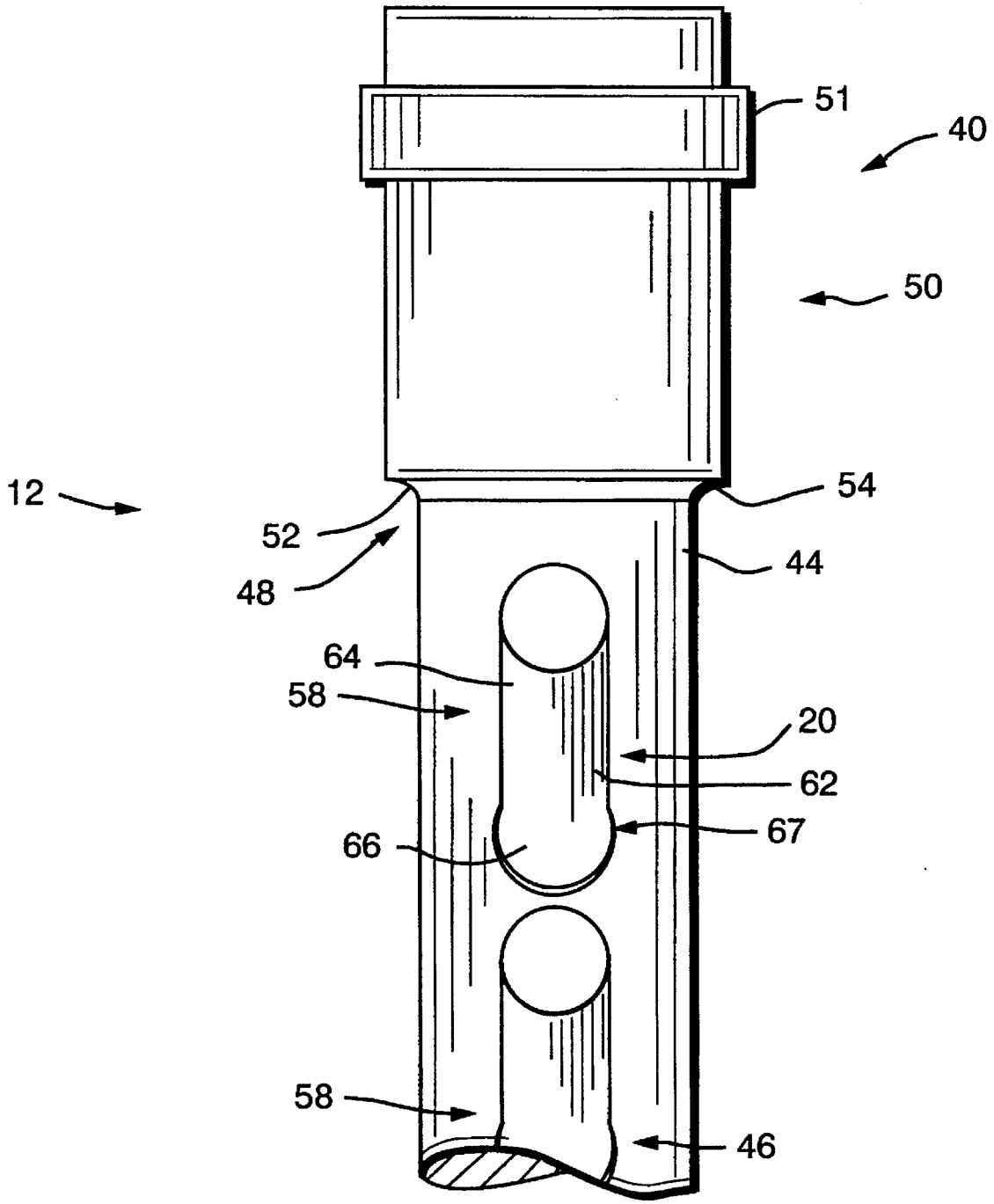
FIG. 4 is a rear view of the inner member of the hockey stick.

The second end 42 is sized and shaped so as to be positionable within the outer member 18 of the handle 12. More particularly, the second end 42 is sized and shaped so that its surfaces 44 will be in substantially surface-to-surface contact with the inner surfaces of the sidewalls 22 of the outer member 18. If desired, a portion of the second end 42 can include a flare 34 that enhances the surface-to-surface contact of the inner member 20 with the outer member 18. The second end 42 of inner member 20 preferably includes a series of apertures 58. These apertures 58 extend transversely through the inner member 20. Preferably, the apertures 58 are cut into the inner member 20 along an axis that is substantially perpendicular to the longitudinal axis of the inner member 20. As best shown in FIG. 3, one side the apertures 58 have a substantially circular configuration 60. The configuration 60 is sized and shaped so as to be less than, or equal to, the lesser of the height or width of the apertures 32 in the outer member 18. On the obverse, as shown in FIG. 4, the apertures 58 have a configuration 62 designed to be substantially congruent to the second apertures 32 in sidewalls 22 of outer member 18 discussed above. More particularly, the configuration 62 has a somewhat skeleton keyhole configuration with a first end portion 64 having a substantially rectangular configuration and a second end portion 66 having a substantially circular configuration. The end portion 66 can include a bevel 67 if desired to facilitate access to the aperture 58. Like the apertures 32, the apertures 58 having a combined configuration 64 and 66 are designed such that they are capable of receiving the locking element 16 when the locking element 16 is in its locked condition as detailed below. The configuration of circular end 66 provides easy access to the locking element 16 when the locking element 16 is in its locked condition so that it can be unlocked and removed for repositioning of the inner member 20.

The inner member 20 typically is manufactured from a wood, metal, or composite substrate. Those skilled-in-the-art will appreciate, however, that the inner member 20 can be manufactured from any material exhibiting sufficient mechanical strength to function as a handle.

Figure 5:
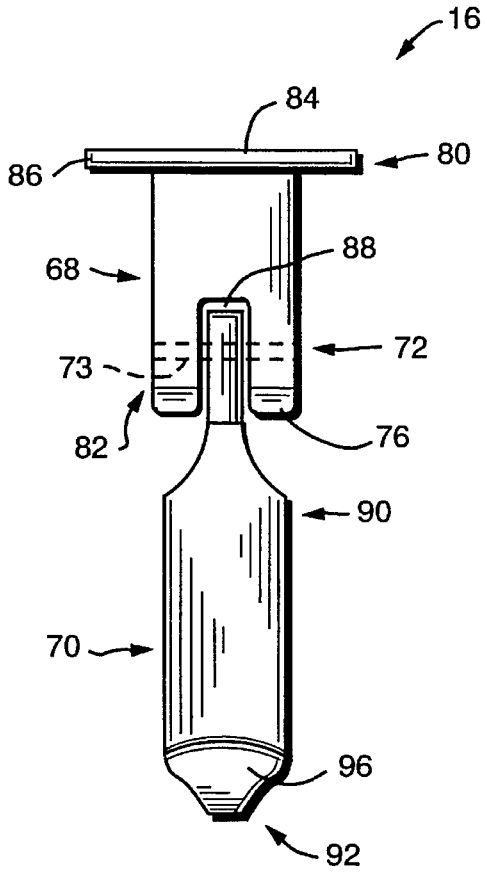
FIG. 5 is a front view of a locking element of the hockey stick.
Figure 6:
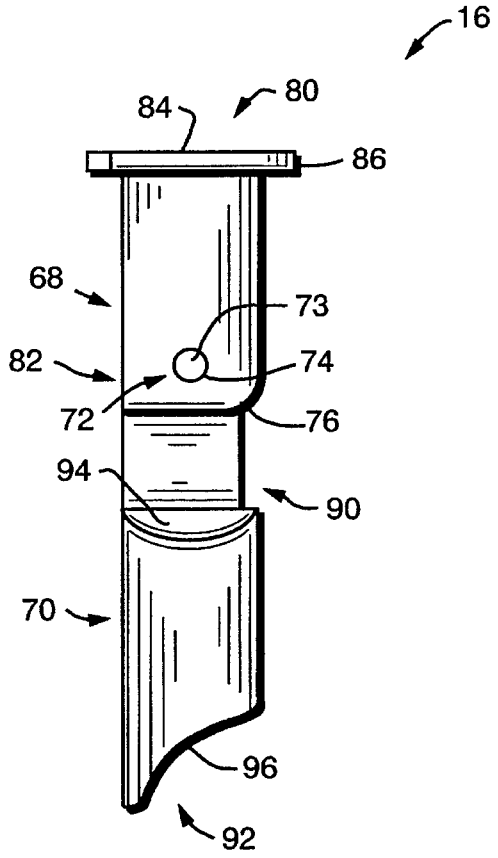
FIG. 6 is a side view of a locking element of the hockey stick.
Figure 7:
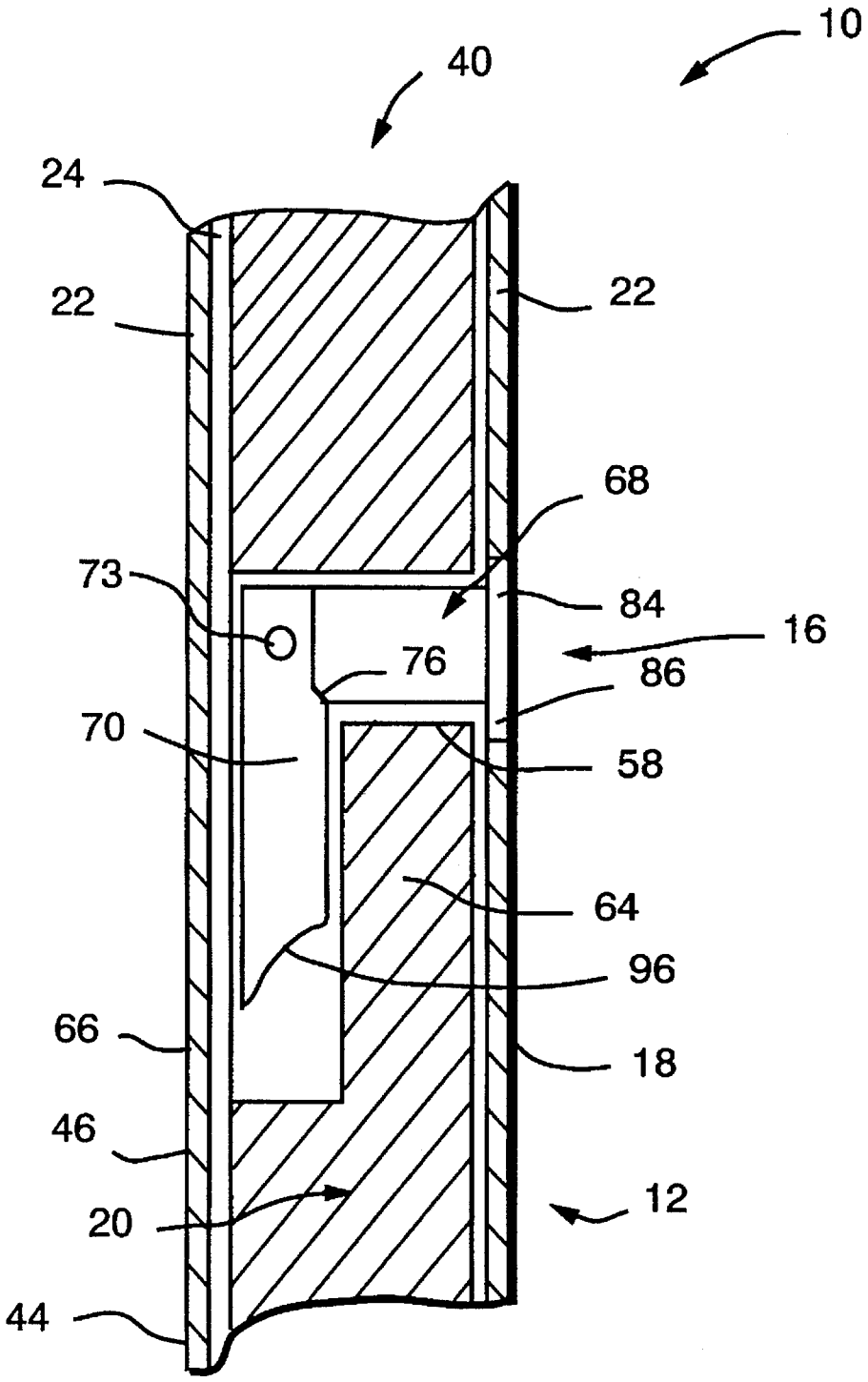
FIG. 7 is a cut-away, side view of the hockey stick showing the inner and outer members locked in position.

As shown in FIG. 5 through 7, the locking element 16 secures the inner member 20 against longitudinal movement relative to the outer member 18. The locking element 16 preferably includes a first portion 68 that is pivotally connected to a second portion 70 by means of a pivot connection 72. The pivot connection 72 is formed using a pin 73 that is positioned in concentrically aligned apertures 74. The pin 73 secures the first portion 68 to the second portion 70. A cam surface 76 at the pivotal connection 72 between the first potion 68 and second portion 70 serves to assist in locking these elements in position.

Preferably, the first portion 68 of the locking element 16 is sized and shaped so as to extend transversely through the apertures 58 and 32 in the inner member 20 and outer member 18 of the handle 12. The first portion 68 includes a head 80 and a tail 82. Typically, the head 80 has a flattened region 84 with a series of working surfaces 86. In operation, as shown in FIG. 7, the working surfaces 86 of the head 80 engage the edges of the aperture 32 in the outer member 18. Preferably, the thickness of the head 80 is substantially identical to the thickness of the sidewalls 22 of the outer member 18. Accordingly, when positioned in the aperture 32 of the outer member 18, the outer surface of the head 80 is substantially flush with the outer surface of the outer member 18. The tail 82 includes pivot 72 as described above. In addition, a slot 88 sized and shaped to receive the second portion 70 of the locking element 16 is formed the tail 82.

The second portion 70 of the locking element 16 acts to secure the locking element 16 in position. The second portion 70 typically is sized and shaped such that it has a cross-sectional dimension that is substantially identical to the cross-sectional dimension of the aperture 64. Selection of these dimensions is preferred as it facilitates interfering engagement of the second portion 70 by the walls of the aperture 64 when the locking element 16 is in its locked condition as shown in FIG. 7. In addition to these dimensional limitations, the second portion 70 of the locking element 16 is preferably sized and shaped so as to extend transversely through the apertures 32 and 58 in the inner member 20 and outer member 18 of the handle 12. Like the first portion 68, the second portion 70 also includes a head 90 and a tail 92. Typically, the head 90 has a taper 94. The taper 94 decreases the size of the head 90 so that it can be positioned within the slot 88 of first portion 68. The tail 92 includes a lip 96 that assists in actuating the second portion 70 during use. Generally, when the second portion 70 is in its secured position it is contained within the aperture 62 formed in the inner member 20.

The locking element 16 typically is manufactured from a metal or composite substrate. Those skilled-in-the-art will appreciate, however, that the locking element 16 can be manufactured from any material exhibiting sufficient mechanical strength to function in the manner described herein.

Figure 2:
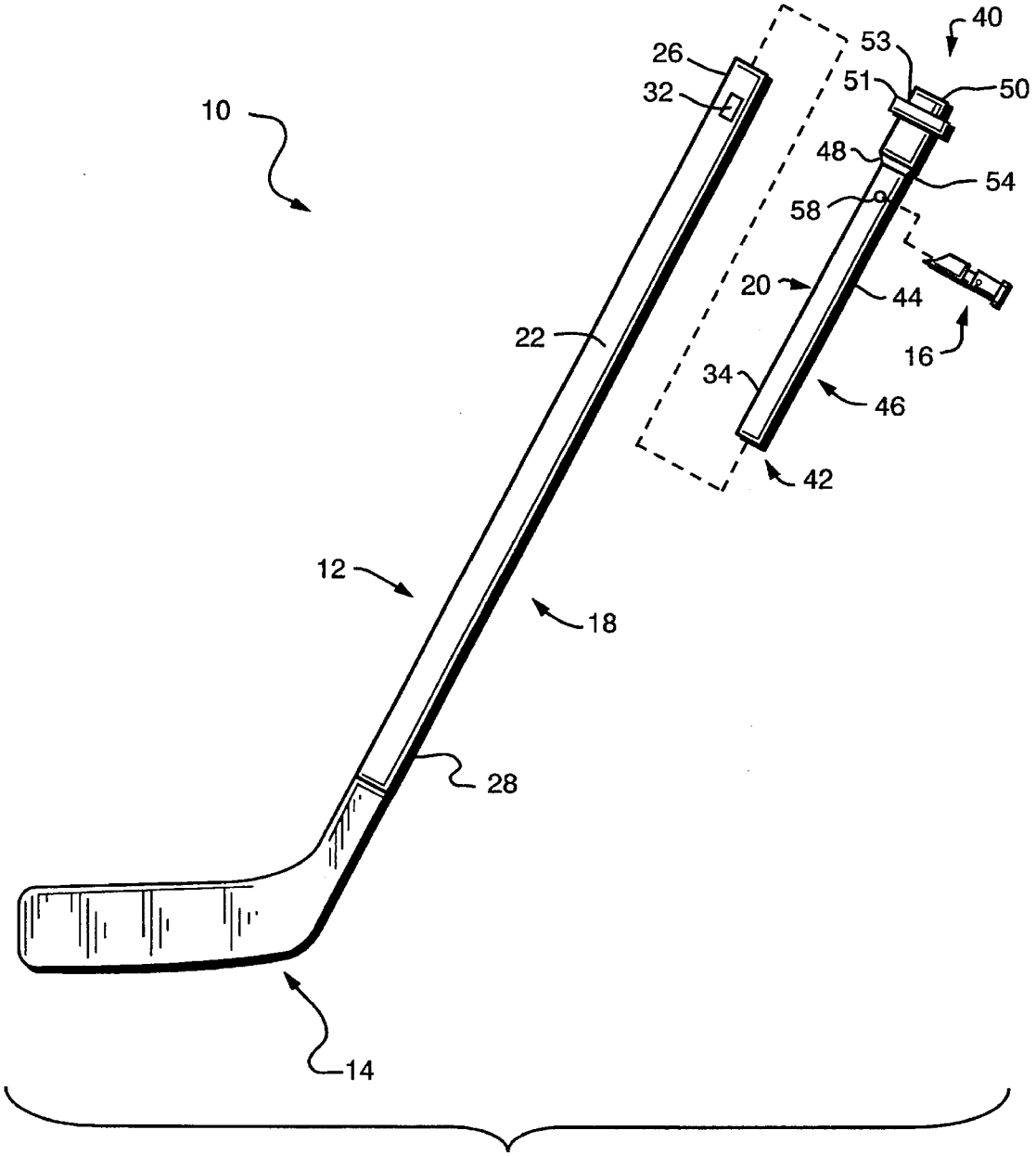
FIG. 2 is an exploded side view of a hockey stick of FIG. 1.

As shown in FIGS. 1 and 2, a blade 14 extends from the second or working end 28 of the handle 12. Typically, the blade 14 is removably and replaceably positionable on the handle 12. In the preferred embodiment of the invention as shown in the several FIGURES, the blade 14 is slightly curved. This curvature is desired as it assists in the receipt and delivery of a hockey puck during play. As those skilled-in-the-art will recognize, the blade 14 is generally sized and shaped to be capable of receiving and shooting a hockey puck. The blade 14 typically is manufactured from a plastic or composite substrate. Those skilled-in-the-art will appreciate, however, that the blade 14 can be manufactured from any material exhibiting sufficient mechanical strength to receive and deliver a hockey puck in the manner commonly experienced by hockey players. Furthermore, the blade 14 can be formed as part of outer member 18 or it can be an attachable member that is secured to the outer member.

In the preferred embodiment of the invention, the locking element 16 is a pin having a size and shape complementary to the configuration of the apertures 58 and 32 in the inner member 20 and outer member 18. To position the pin, the apertures 32 and 58 in the inner member 20 and outer member 18 are first concentrically aligned. The pin is then thrust through the apertures 32 and 58 until the head region 80 of the first portion 68 is flush with an outer surface of the sidewalls 22 of the outer member 18. The second portion 70 is then pivoted inwardly so that it is contained with the aperture 64 in the inner member 20.

To use the hockey stick 10 of the invention, the relative positions of the inner member 20 and outer member 18 are positioned as necessary in order to achieve the desired length for the hockey stick 10. With the locking element 16 removed, the inner member 20 is slidably moved in outer member 18 until handle 12 is at the desired length. Then, to the degree necessary, the apertures 32 and 58 are brought into substantially coaxial alignment. The locking element 16 is then thrust through the apertures 32 and 58, second portion 70 first, until the head 80 of the first portion 68 of the locking element 16 is contained within the aperture 32 and flush with the outer surface of the sidewall 22 of the outer member 18. The locking member 16 is then rotated until it is possible to pivot the second portion 70 inwardly into the aperture 64 of the inner member 20. To complete the procedure, the second portion 70 is pivoted into the aperture 64 until the walls of the second portion 70 interferringly engage the walls of the aperture 64.

To later readjust the length of the hockey stick 10, the second portion 70 is pivoted outwardly until it is in alignment with the first portion 68. As best shown in FIG. 7, enlarge circular portion 66 permits easy access to lip 96 of tail 92. The locking element 16 is then pushed out of the apertures 32 and 58 until separated from the outer member 18 and inner member 20. The relative positions of the outer member 18 and inner member 20 are then adjusted as desired to achieve a new length for the hockey stick 10. To complete the adjustment procedure, the locking element 16 is thrust back through the apertures 32 and 58, second portion 70 first, until the head 80 of the first portion 68 of the locking element 16 is again contained within the aperture 32 and flush with the surface of the sidewalls 22 of the outer member 18. The locking member 16 is then rotated until it is possible to pivot the second portion 70 into the aperture 64 of the inner member 20. The second portion 70 is then pivoted into the aperture 64 until the walls of the second portion 70 interferringly engage the walls of the aperture 64.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed is:

1. An adjustable length hockey stick, said hockey stick comprising:

(a) an elongate handle means, said handle means having a first end and a second end, said handle means including an outer member and an inner member, said inner member being telescopically positionable in said outer member, said inner member being frictionally engaged in substantially surface-to-surface contact with said outer member, said inner member extending from said first end of said handle means;

(b) a locking means for securing said inner member against longitudinal movement relative to said outer member; and, (c) a blade means extending from said second end of said handle means.

2. The hockey stick as claimed in claim 1 wherein said inner member is sized and shaped to be slidable in said outer member, said inner member having a head portion on said end extending from said first end of said handle means, said head portion configured to provide a stop that limits insertion of said inner member into said outer member.

3. The hockey stick as claimed in claim 2 wherein said handle means is formed with a first aperture and a second aperture, said first aperture extending transversely through said outer member, said second aperture extending transversely through said inner member.

4. The hockey stick as claimed in claim 3 wherein said locking means includes a pin means, said pin means being sized and shaped to extend through said first aperture and said second aperture when said first aperture and said second aperture are in alignment.

5. The hockey stick as claimed in claim 4 wherein said pin means includes a first portion pivotally connected to a second portion, said first portion being sized and shaped so as to be able to extend transversely through said first and second apertures in said outer and inner members, said second portion being configured to provide a securing means for securing said locking means within said first aperture and said second aperture.

6. The hockey stick as claimed in claim 5 wherein said first portion and said second portion of said locking means are sized and shaped so that, when said locking means is secured in position, an end of said first portion of said locking means and an outer surface of said outer member are flush and said second portion is contained in said aperture in said inner member.

7. The hockey stick as claimed in claim 6 wherein said pivotal connection between said first portion of said locking means and said second portion of said locking means is provided with a cam locking surface.

8. The hockey stick as claimed in claim 1 wherein said blade means is sized and shaped to receive a hockey puck.

9. An adjustable length hockey stick, said hockey stick comprising:

(a) an elongate handle means, said handle means having a first end and a second end, said handle means including an outer member and an inner member, said outer member providing a grip means, said inner member being telescopically positionable in said outer member, said inner member being frictionally engaged in substantially surface-to-surface contact with said outer member, said inner member extending from said first end of said handle means, said inner member including a stop means for limiting the insertion of said inner member into said outer member;

(b) a locking means for securing said inner member against longitudinal movement relative to said outer member; and (c) a blade means extending from said second end of said handle means.

10. The hockey stick as claimed in claim 9 wherein said handle means is formed with a first aperture and a second aperture, said first aperture extending transversely through said outer member, said second aperture extending transversely through said inner member.

11. The hockey stick as claimed in claim 10 wherein said locking means includes a pin means, said pin means being sized and shaped to extend through said first aperture and said second aperture when said first aperture and said second aperture are in concentric alignment.

12. The hockey stick as claimed in claim 11 wherein said pin means includes a first portion pivotally connected to a second portion, said first portion being sized and shaped so as to be able to extend transversely through said first and second apertures in said outer and inner members, said second portion being configured to provide a securing means for securing said locking means within said first aperture and said second aperture.

13. The hockey stick as claimed in claim 12 wherein said first portion and said second portion of said locking means are sized and shaped so that, when said locking means is secured in position an end of said first portion of said locking means and an outer surface of said outer member are flush and said second portion folds is contained within said inner member.

14. The hockey stick as claimed in claim 13 wherein said pivotal connection between said first portion of said locking means and said second portion of said locking means is provided with a cam locking surface.

15. The hockey stick as claimed in claim 9 wherein said blade means is sized and shaped to receive a hockey puck.

16. An adjustable length hockey stick, said hockey stick comprising:

(a) an elongate handle means, said handle means having a gripping end and a working end, said handle means including an outer member and an inner member, a portion of said inner member slidably received in said outer member, an outer surface of said portion of said inner member received in said outer member is in substantially full surface-to-surface contact with an inner surface of said outer member, said outer surface of said portion of said inner member received in said outer member being in frictionally slidable engagement with said inner surface of said outer member;

(b) a locking means for securing said inner member and said outer member against relative longitudinal movement; and (c) a hockey blade means provided at the working end of said handle means.

17. The hockey stick as claimed in claim 16 wherein said handle means is formed with a first aperture and a second aperture, said first aperture extending transversely through said outer member, said second aperture extending transversely through said inner member.

18. The hockey stick as claimed in claim 17 wherein said locking means includes a pin means, said pin means being sized and shaped to extend through said first aperture and said second aperture when said first aperture and said second aperture are in alignment.

19. The hockey stick as claimed in claim 18 wherein said pin means includes a first portion pivotally connected to a second portion, said first portion being sized and shaped so as to be able to extend transversely through said first and second apertures in said outer and inner members, said second portion being configured to provide a securing means for securing said locking means within said first aperture and said second aperture, said first portion and said second portion of said locking means being sized and shaped so that, when said locking means is secured in position, an end of said first portion of said locking means and an outer surface of said outer member are flush and said second portion is contained in said aperture in said inner member.

* * * * *